US005756268A

United States Patent [19]

Draber et al.

[11] Patent Number: 5,756,268

[45] Date of Patent: May 26, 1998

[54] PROCESSING COLOR PHOTOGRAPHIC MATERIALS

[75] Inventors: Edgar Draber, Odenthal; Rudolf Tromnau, Köln; Manfred Peters, Leverkursen, all of Germany

[73] Assignee: Agfa-Gevaert AG, Germany

[21] Appl. No.: 844,754

[22] Filed: Apr. 21, 1997

[30] Foreign Application Priority Data

Apr. 25, 1996 [DE] Germany ..... 196 16 499.0

[51] Int. Cl.[6] ..... G03C 7/407

[52] U.S. Cl. ..... 430/350; 430/351; 430/373; 430/414

[58] Field of Search ..... 430/350, 351, 430/373, 414

[56] References Cited

U.S. PATENT DOCUMENTS 5,547,818 8/1996 Lapp et al. ..... 430/505
5,672,466 9/1997 Okamura et al. ..... 430/351

*Primary Examiner*—Hoa Van Le
*Attorney, Agent, or Firm*—Connolly & Hutz

[57] ABSTRACT

If a color photographic material, which is processed by the process steps a) image-by-image exposure, b) color developing, c) bleaching, d) fixing, e) washing or stabilizing, and f) drying, wherein steps c) and d) may be combined to constitute bleach-fixing, is subjected to a temperature treatment of 0.01 to 30 seconds at 60 to 240° C. between exposure and color developing, an increase of the contrast can thereby be obtained.

3 Claims, No Drawings

PROCESSING COLOR PHOTOGRAPHIC MATERIALS

This invention relates to the processing of colour photographic silver halide materials to achieve a higher contrast.

Depending on the subject of the image, colour photographic images are wanted which are of low contrast (e.g. portraits) or high contrast (e.g. landscape photographs), and the option of being able to select from many contrast stages is particularly desirable. This can be achieved, for example, by means of the photographic material (film) or by means of the printing material (photographic paper) or by means of the photographic conditions (illumination). However, it frequently happens that the photographic material and the photographic conditions are already permanently fixed, and an effect on the contrast can only be obtained by selecting the printing material from a series of printing materials of different gradations (extra soft, soft, normal, hard, extra hard, etc.).

This presupposes a costly and uneconomic stockholding and corresponding logistics, and necessitates considerably more time than the processing of one kind of paper only, due to the constant change of printing material.

A colour negative paper with a variable gradation has already been proposed (DE-A-44 23 129), which, in addition to the usual blue-, green- and red-sensitised silver halide emulsion layers which contain colour couplers, contains at least one silver halide emulsion layer which is free from colour couplers, the silver halide emulsion layer of which (the control emulsion) is sensitised but is not blue-, green- or red-sensitised and contains a substance which when the colour negative is developed releases a compound which changes the gradation of at least one layer which contains a colour coupler.

With this material, the change in gradation is achieved by exposing the material without forming an image, before or after its image-by-image exposure, to light of a wavelength within the spectral range to which the control emulsion is sensitive, and by exposing it during its image-by-image exposure to light which contains no components of light to which the control emulsion is sensitive. These different exposures can be effected with the aid of white light which is correspondingly filtered.

The material requires further components and is more expensive to manufacture than is conventional colour negative paper.

The object of the present invention was to obtain a change of gradation using customary photographic material.

This object has been achieved using a variant of the customary processing procedure.

The present invention therefore relates to a method of processing a colour photographic material, particularly a colour negative paper, by the processing steps a) image-by-image exposure, b) colour developing, c) bleaching, d) fixing, e) washing or stabilising, and f) drying, wherein steps c) and d) may be combined to constitute bleach-fixing, characterised in that in order to increase the gradation of the image to be produced the material is subjected to a temperature treatment between exposure and developing, which temperature treatment lasts 0.01 to 30 seconds, preferably 0.1 to 2 seconds, and falls within the temperature range of 60° to 240° C., preferably 80° to 160° C.

The increase in contrast is greater the longer the temperature treatment lasts and the higher the selected temperature is.

More prolonged heating at temperatures above 100° C. is to be avoided, however, since there is then the risk of damage to the material.

The time which elapses between image-by-image exposure and heat treatment, and between heat treatment and developing, respectively, is completely non-critical; for printing materials such as colour negative papers these times will be kept as short as possible for reasons of process economy.

The effect of heat may be produced by a heated pair of rollers through which the material is transported, for example, wherein the roller on the layer side, the roller on the back, or both rollers may be heated. The time of heating is determined by the speed of transport of the material and by its arc of contact with the heated roller.

Alternatively, infrared radiators or microwave devices may also be used.

Examples of colour photographic materials include colour negative films, colour reversal films, colour positive films, colour photographic paper and colour reversal photographic paper.

Photographic materials consist of a support on which at least one light-sensitive silver halide emulsion layer is deposited. Thin films and foils are particularly suitable as supports. A review of support materials and of the auxiliary layers which are deposited on the front and back thereof is presented in Research Disclosure 37254, Part 1 (1995), page 285.

Colour photographic materials usually contain at least one red-sensitive, one green-sensitive and one blue-sensitive silver halide emulsion layer in each case, and optionally also contain intermediate layers and protective layers.

Depending on the type of photographic material, these layers may be arranged differently. This will be illustrated for the most important products:

Colour photographic films such as colour negative films and colour reversal films comprise, in the following sequence on the support, 2 or 3 red-sensitive, cyan-coupling silver halide emulsion layers, 2 or 3 green-sensitive, magenta-coupling silver halide emulsion layers and 2 or 3 blue-sensitive, yellow-coupling silver halide emulsion layers. Layers which have the same spectral sensitivity differ as regards their photographic sensitivity, and the less sensitive partial layers are generally disposed nearer the support than are the more highly sensitive partial layers.

Between the green-sensitive and blue-sensitive layers there is usually a yellow filter layer which prevents blue light from reaching the layers situated below it.

Possible forms of different layer arrangements and their effects on photographic properties are described in J. Int. Rec. Mats., 1994, Vol. 22, pages 183–193.

Colour photographic paper, which is generally less light-sensitive than a colour photographic film, usually comprises, in the following sequence on the support, a blue-sensitive, yellow-coupling silver halide emulsion layer, a green-sensitive, magenta-coupling silver halide emulsion layer and a red-sensitive, cyan-coupling silver halide emulsion layer; the yellow filter layer may be omitted.

Variations in the number and arrangement of the light-sensitive layers can be made in order to obtain certain results. For example, all the high-sensitivity layers can be combined to form one layer stack and all the low-sensitivity layers can be combined to form another layer stack in a photographic film, in order to increase the film speed (DE 25 30 645).

The essential constituents of the photographic emulsion layers are binders, silver halide grains and colour couplers.

Information on suitable binders is to be found in Research Disclosure 37254, Part 2 (1995), page 286.

Information on suitable silver halide emulsions, and on the production, ripening, stabilisation and spectral sensitisation thereof, including suitable spectral sensitisers, is to be found in Research Disclosure 37254, Part 3 (1995), page 286 and in Research Disclosure 37038, Part XV (1995), page 89.

Photographic materials which have a speed of response suitable for cameras usually contain silver bromide-iodide emulsions, which may optionally also contain small proportions of silver chloride. Photographic printing materials contain either silver chloride-bromide emulsions comprising up to 80 mole % AgBr or silver chloridebromide emulsions comprising more than 95 mole % AgCl.

Information on colour couplers is to be found in Research Disclosure 37254, Part 4 (1995), page 288, and in Research Disclosure 37038, Part II (1995), page 80. The maximum absorption of the dyes formed from the couplers and from the colour developer oxidation product is preferably within the following ranges: yellow couplers 430 to 460 nm, magenta couplers 540 to 560 nm, cyan couplers 630 to 700 nm.

In order to improve film speed, granularity, sharpness and colour separation, compounds are frequently used in colour photographic films which, on their reaction with the developer oxidation product, release compounds which are photographically active, e.g. DIR couplers, which release a development inhibitor.

Information on compounds such as these, particularly on couplers, is to be found in Research Disclosure 37254, Part 5 (1995), page 290, and in Research Disclosure 37038, Part XIV (1995), page 86.

The colour couplers, which are mostly hydrophobic, and other hydrophobic constituents of the layers also, are usually dissolved or dispersed in high boiling organic solvents. These solutions or dispersions are then emulsified in an aqueous solution of a binder (usually a gelatine solution), and after drying the layers are present as fine droplets (0.05 to 0.8 μm diameter) in the layers.

Suitable high boiling organic solvents, methods of introducing a photographic material into the layers, and other methods of introducing chemical compounds into photographic layers, are to be found in Research Disclosure 37254, Part 6 (1995), page 292.

The non-light-sensitive intermediate layers, which are generally disposed between layers of different spectral sensitivity, may contain media which prevent the unwanted diffusion of developer oxidation products from one light-sensitive layer into another light-sensitive layer with a different spectral sensitisation.

Suitable compounds (white couplers, scavengers or EOP scavengers) are to be found in Research Disclosure 37254, Part 7 (1995), page 292 and in Research Disclosure 37038, Part III (1995), page 84.

In addition, the photographic material may contain compounds which absorb UV light, optical brighteners, spacers, filter dyes, formatin scavengers, light stabilisers, antioxidants, $D_{Min}$ dyes, additives for improving the stability of the dyes, of the couplers and of the whiteness and for reducing colour fogging, plasticisers (latices), biocides and others.

Suitable compounds are to be found in Research Disclosure 37254, Part 8 (1995), page. 292 and in Research Disclosure 37038, Parts IV, V, VI, VII, X, XI and XIII (1995), page 84 et seq.

The layers of colour photographic materials are usually hardened, i.e the binder which is used, preferably gelatine, is crosslinked by suitable chemical methods.

Suitable hardener substances are to be found in Research Disclosure 37254, Part 9 (1995), page 294 and in Research Disclosure 37038, Part XII (1995), page 86.

After their image-by-image exposure, colour photographic materials are processed by various methods corresponding to their character. Details of the procedures used and the chemicals required therefor are published, together with examples of materials, in Research Disclosure 37254, Part 10 (1995), page 294, and in Research Disclosure 37038, Parts XVI to XXIII (1995), page 95 et seq.

The material to be processed is preferably a colour negative paper, which contains, in the given sequence on a support comprising paper which is coated on both sides with polyethylene, a blue-sensitive, yellow-coupling silver halide emulsion layer, a green-sensitive, magenta-coupling silver halide emulsion layer, and a red-sensitive, cyan-coupling silver halide emulsion layer, as well as customary intermediate and protective layers, wherein at least 95 mole % of the silver halides of the silver halide emulsion layers consist of AgCl an are substantially iodide-free.

A product such as this is usually processed by a standard procedure which is known by the designations RA-4 or AP 94. With the exception of the additional heat treatment, the process according to the invention likewise preferably utilises the processing conditions of these procedures.

EXAMPLE 1

A colour photographic recording material which was suitable for a rapid processing procedure was produced by depositing the following layers in the given sequence on a layer support consisting of paper coated on both sides with polyethylene. The quantitative data are given with respect to 1 $m^2$ in each case. The corresponding amounts of $AgNO_3$ are given for the silver halide deposition.

| Layer structure Sample 1 | |
|---|---|
| Layer 1: | (substrate layer) |
| | 0.2 g gelatine |
| Layer 2: | (blue-sensitive layer) |
| | blue-sensitive silver halide emulsion (99.5 mole % chloride, 0.5 mole % bromide, average grain diameter 0.8 μm), comprising |
| | 0.45 g $AgNO_3$ with |
| | 1.11 g gelatine |
| | 0.60 g yellow coupler Y-1 |
| | 0.15 g white coupler W-1 |
| | 0.06 g coupler solvent OF-1 |
| | 0.24 g tricresyl phosphate (TCP) |
| Layer 3: | (protective layer) |
| | 1.1 g gelatine |
| | 0.04 g 2,5-di-tert.-octyl hydroquinone |
| | 0.04 g compound SC-1 |
| | 0.06 g TCP |
| Layer 4: | (green-sensitive Layer) |
| | green-sensitised silver halide emulsion (99.5 mole % chloride, 0.5 mole % bromide, average grain diameter 0.5 μm), comprising |
| | 0.25 g $AgNO_3$ with |
| | 0.95 g gelatine |
| | 0.20 g magenta coupler M-1 |
| | 0.20 g dye stabiliser ST-1 |
| | 0.10 g dye stabiliser ST-2 |
| | 0.18 g coupler solvent OF-2 |
| | 0.12 g coupler solvent OF-3 |
| Layer 5: | (UV protection layer) |
| | 0.75 g gelatine |
| | 0.2 g UV absorber UV-1 |
| | 0.1 g UV absorber UV-2 |
| | 0.025 g 2,5-di-tert.-octyl hydroquinone |
| | 0.02 g compound SC-1 |
| | 0.1 g coupler solvent OF-4 |
| | 0.04 g TCP |
| Layer 6: | (red-sensitive Layer) |
| | red-sensitised silver halide emulsion (99.5 mole % chloride, |

-continued

| Layer structure Sample 1 |
|---|
| 0.5 mole % bromide, average grain diameter 0.5 μm), comprising |
| 0.30 g $AgNO_3$ with |
| 0.75 g gelatine |
| 0.36 g cyan coupler C-1 |
| 0.36 g TCP |
| Layer 7: (UV protection layer) |
| 0.85 g gelatine |
| 0.36 g UV absorber UV-1 |
| 0.18 g UV absorber UV-2 |
| 0.18 g coupler solvent OF-4 |
| Layer 8: (protective layer) |
| 0.9 g gelatine |
| 0.3 g hardener H-1 |

The following compounds were used in the tests of Example 1:

Y-1

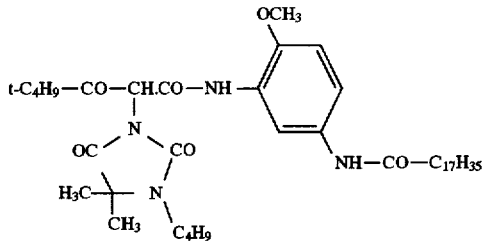

M-1

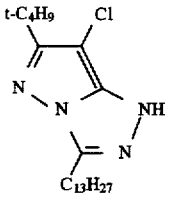

C-1

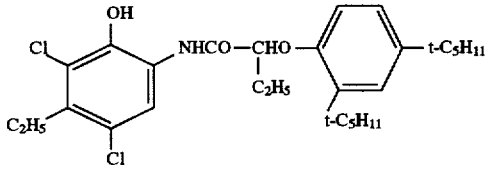

W-1

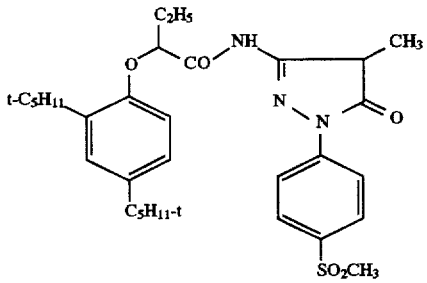

ST-1

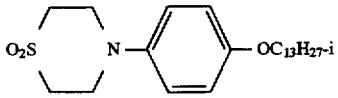

ST-2

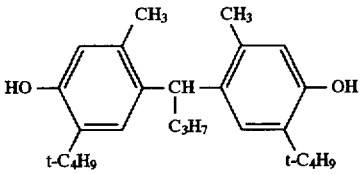

-continued

OF-1

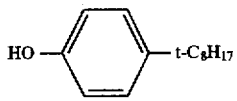

OF-2 $C_4H_9O-CO-(CH_2)_4-CO-OC_4H_9$

OF-3 $C_{14}H_{29}-OH/C_{12}H_{25}-OH(1:3)$

OF-4 $i\text{-}H_{19}C_9OCO-(CH_2)_4-COOC_9H_{19}\text{-}i$

SC-1

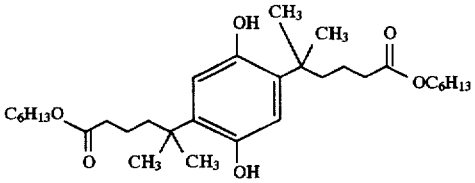

UV-1

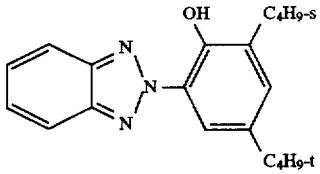

UV-2

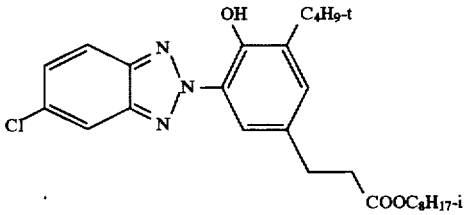

H-1

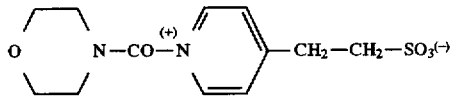

The material was exposed behind a graduated neutral wedge filter, heated under the conditions given in the Table between two rollers, of which the roller on the layer side was heated, and was processed as follows:

a) Colour developer—45 seconds—35° C.

| | |
|---|---|
| tetraethylene glycol | 20.0 g |
| N,N-diethylhydroxylamine | 4.0 g |
| N-ethyl-N-(2-methanesulphonamidoethyl)-4-amino-3-methylbenzene sesquisulphate | 5.0 g |
| potassium sulphite | 0.2 g |
| potassium carbonate | 30.0 g |
| polymaleic anhydride | 2.5 g |
| hydroxyethanediphosphonic acid | 0.2 g |
| optical brightener (4,4'-diaminestilbene-sulphonic acid derivative) | 2.0 g |
| potassium bromide | 0.02 g |

made up to 1000 ml with water; pH adjusted to pH 10.2 with KOH or $H_2SO_4$.

b) Bleach-fixing bath—45 seconds—35° C.

| | |
|---|---|
| ammonium thiosulphate | 75.0 g |
| sodium hydrogen sulphite | 13.5 g |
| ethylenediaminetetraacetic acid (iron-ammonium salt) | 45.0 g |

made up to 1000 ml with water; pH adjusted to pH 6.0 with ammonia (25% by weight) or acetic acid.

c) Washing—2 minutes—33° C.

d) Drying

The first column of the Table gives the temperature T of heat treatment, the second column gives the duration $t_1$ of heat treatment, the third column gives the time $t_2$ between exposure and heat treatment, and the fourth column gives the time $t_3$ between exposure and developing. The fifth column gives the gradation G for yellow (yl), magenta (mg) and cyan (cy) in the form of the increase in the secant of the sensitometric curve between density 0.95 and density 1.7, wherein the first line gives absolute values and the following lines give the differences from the absolute values. The sixth column gives the maximum density $D_{max}$ for yellow, and the same considerations apply to the first line and the following lines as those which apply to the gradation. The seventh column shows what is according to the invention and what is not.

| T | $t_1$ [sec] | $t_2$ | $t_3$ | G*100 yl/mg/cy | $D_{max}$ (yl) | |
|---|---|---|---|---|---|---|
| 25° C. | — | — | 45 sec | 323/320/389 | 2.59 | comparison |
| 25° C. | 2 | 20 sec | 45 sec | 5/10/4 | +0.04 | comparison |
| 100° C. | 2 | 20 sec | 45 sec | 85/74/91 | +0.09 | invention |
| 100° C. | 0.5 | 20 sec | 45 sec | 29/15/20 | +0.03 | invention |
| 100° C. | 2 | 1 min | 1 hour | 73/70/81 | +0.05 | invention |
| 100° C. | 2 | 20 sec | 2 min | 83/74/87 | +0.03 | invention |
| 60° C. | 5 | 20 sec | 45 sec | 28/26/19 | +0.09 | invention |
| 80° C. | 2.5 | 20 sec | 45 sec | 31/15/21 | +0.04 | invention |
| 120° C. | 0.5 | 20 sec | 45 sec | 38/21/27 | +0.05 | invention |
| 160° C. | 0.5 | 20 sec | 45 sec | 55/59/45 | +0.05 | invention |
| 160° C. | 0.5 | 4 min 45 sec | 5 min | 45/52/47 | +0.08 | invention |
| 160° C. | 0.5 | 5 sec | 5 min | 60/61/53 | +0.09 | invention |

-continued

| T | $t_1$ [sec] | $t_2$ | $t_3$ | G*100 yl/mg/cy | $D_{max}$ (yl) | |
|---|---|---|---|---|---|---|
| 160° C. | 0.5 | 1 hour | 1 day | 35/40/41 | +0.06 | invention |
| 180° C. | 0.5 | 20 sec | 45 sec | 65/57/54 | +0.05 | invention |

We claim:

1. A method of processing a color photographic material which comprises the following process steps a) image-by-image exposure, b) color developing, c) bleaching, d) fixing, e) washing or stabilizing, and f) drying, wherein steps c) and d) may be combined to constitute bleach-fixing, and in order to increase the contrast of the image to be produced the material is subjected to a temperature treatment between said exposure and said developing, which temperature treatment lasts 0.01 to 30 seconds and falls within the temperature range of 60° to 240° C.

2. A method according to claim 1, wherein the temperature treatment lasts 0.1 to 5 seconds and falls within the temperature range from 80° to 160° C.

3. A method according to claim 1, wherein the color photographic material is a color negative paper.

* * * * *